US008267299B2

(12) United States Patent
Osuga

(10) Patent No.: US 8,267,299 B2
(45) Date of Patent: Sep. 18, 2012

(54) GAS COMBUSTION-TYPE DRIVING TOOL

(75) Inventor: Satoshi Osuga, Tokyo (JP)

(73) Assignee: Max Co., Ltd., Chuo-ku, Tokyo (JP)

( * ) Notice: Subject to any disclaimer, the term of this patent is extended or adjusted under 35 U.S.C. 154(b) by 34 days.

(21) Appl. No.: 12/438,638

(22) PCT Filed: Aug. 13, 2007

(86) PCT No.: PCT/JP2007/065809

§ 371 (c)(1),
(2), (4) Date: Feb. 24, 2009

(87) PCT Pub. No.: WO2008/023591

PCT Pub. Date: Feb. 28, 2008

(65) Prior Publication Data

US 2010/0243700 A1 Sep. 30, 2010

(30) Foreign Application Priority Data

Aug. 25, 2006 (JP) ..... 2006-229743

(51) Int. Cl.
*B25C 1/14* (2006.01)

(52) U.S. Cl. ..... 227/10; 227/8; 227/130; 123/46 SC

(58) Field of Classification Search ..... 227/8, 10, 227/130; 123/46 SC
See application file for complete search history.

(56) References Cited

U.S. PATENT DOCUMENTS

| | | | | |
|---|---|---|---|---|
| 4,712,379 A | | 12/1987 | Adams et al. | |
| 5,090,606 A | * | 2/1992 | Torii et al. | 227/10 |
| 5,687,898 A | * | 11/1997 | Toulouse | 227/8 |
| 6,889,885 B2 | * | 5/2005 | Ohmori | 227/10 |
| 7,267,257 B2 | * | 9/2007 | Erhardt et al. | 227/10 |
| 7,341,174 B1 | * | 3/2008 | Wen | 227/130 |

FOREIGN PATENT DOCUMENTS

| | | |
|---|---|---|
| DE | 42 43 614 A1 | 6/1994 |
| JP | 7-36985 | 4/1995 |
| JP | 2001-260049 | 9/2001 |
| JP | 2004-358655 | 12/2004 |
| JP | 2005-212060 | 8/2005 |
| WO | 2005/044956 | 5/2005 |
| WO | 2005/077608 | 8/2005 |

* cited by examiner

*Primary Examiner* — Brian D Nash
*Assistant Examiner* — Michelle Lopez
(74) *Attorney, Agent, or Firm* — Drinker Biddle & Reath LLP

(57) ABSTRACT

A driving piston 7 is provided so as to be slidable in an up-down direction within a driving cylinder 6 disposed within a body 1. A movable sleeve is fitted on the outer peripheral side of the driving cylinder 6 on the cylinder so as to be movable in the up-down direction. When the movable sleeve 11 is moved upward to abut against a cylinder head 10 provided in the upper direction, a sealed combustion chamber 5 is formed. When combustible mixed gas is explosively burnt within the combustion chamber 5, high-pressure combustion gas acts on the driving piston 7 to thereby impulsively drive the piston, whereby a fastener is driven out by a driver 8 coupled on the lower surface side of the driving piston 7. Elastic members 15 are disposed between the movable sleeve 11 and the cylinder head 10. The elastic members 15 bias the movable sleeve 11 downward.

5 Claims, 4 Drawing Sheets

GAS COMBUSTION-TYPE DRIVING TOOL

TECHNICAL FIELD

The present invention relates to a gas combustion-type driving tool for driving a faster such as a nail.

BACKGROUND ART

In general, in a gas combustion-type driving tool, a driving piston is provided so as to be slidable in an up-down direction within a driving cylinder disposed within a body. A tubular movable sleeve is fitted on the outer peripheral side of the driving cylinder on the cylinder so as to be movable in the up-down direction. The movable sleeve is biased downward by a spring so as to be always located at the lower position. Upon a striking operation, the movable sleeve is moved upward against the spring and abuts to a cylinder head provided at above the driving cylinder to thereby form an air tight combustion chamber. Then, when combustion gas within the combustion chamber is ignited and explosively burnt, a driver is driven together with the driving piston to drive out a fastener.

Conventionally, a spring member for biasing the movable sleeve downward is positioned beneath or on the side surface of the driving cylinder (Patent Documents 1 and 2).

For example, in a gas combustion-type driving tool according to the Patent Document 1, the spring member is provided at the forward position of a nose portion disposed beneath the cylinder to thereby bias a contact arm beneath the gas combustion-type driving tool.

Further, FIG. 2 of the Patent Document 2 shows that a spring member is provided around the driving cylinder within the gas combustion-type driving tool, and FIG. 8 shows that a spring member is disposed beneath the cylinder to thereby bias a contact arm beneath the gas combustion-type driving tool.

Patent Document 1: JP-A-2005-212060

Patent Document 2: JP-B-07-036985

However, in a system where an elastic member such as a spring member is provided beneath a cylinder like the gas combustion-type driving tool shown in FIG. 9 of the Patent Document 2, it is required to provide a dedicated space for disposing the elastic member and so there arise a problem that the entire height of the gas combustion-type driving tool becomes high.

Further, in the case where the spring member is provided on the front surface of the nose portion or around the driving cylinder like the gas combustion-type driving tool described in the patent document 1 or shown in FIG. 2 of the Patent Document 2, a protection cover is required in order for an operator to position a driven member at the portion. Thus, there arises a problem that a size around the nose portion becomes larger and so it is difficult to drive a nail in a narrow space etc.

Further, according to the aforesaid arrangements of the spring member, there arises a problem that the exchanging procedure of the spring member is complicated and troublesome.

DISCLOSURE OF THE INVENTION

One or more embodiments of the invention provides a gas combustion-type driving tool in which the entire height and the outer diameter of the gas combustion-type driving tool are suppressed to be small, whereby the miniaturization and light-weight of the tool can be realized, the workability at a narrow place etc. can be improved, the tool can be used easily, and the maintenance property of the tool is good since the elastic member can be exchanged easily.

According to a first aspect of the invention, in a gas combustion-type driving tool, a driving piston is provided so as to be movable in an up-down direction within a driving cylinder which is disposed within a body. A movable sleeve is fitted on the outer peripheral side of the driving cylinder on the driving cylinder so as to be movable in the up-down direction. When the movable sleeve is moved upward and abutted against a cylinder head which is provided above the driving cylinder, a sealed combustion chamber is formed. When mixed gas of combustible gas and air is burnt explosively within the combustion chamber, high-pressure combustion gas acts on the driving piston to thereby impulsively drive the piston, whereby a fastener is driven out by a driver coupled on the lower surface side of the driving piston. An elastic member is disposed between the movable sleeve and the cylinder head and biases the movable sleeve downward.

According to a second aspect of the invention, the elastic member is configured by a plurality of elastic members which may be disposed so as to have the same interval therebetween around the axis of the driving cylinder.

According to the first aspect of the invention, it is not necessary to provide the dedicated space for disposing elastic members unlike the related art. Thus, the entire height of the tool can be suppressed to be low as compared with the case where the elastic member is provided at a dedicated space beneath the driving cylinder at the lower portion of the driving cylinder. Similarly, since the elastic member is not disposed at the front portion of a nose portion or around the driving cylinder, the outer diameter of the tool can also be suppressed so as not to be large, which contributes to the miniaturization and the light-weight. Further, since the driving operation can be performed in a state that the tip end of the nose portion is inserted into a narrow space, the operability and the handling property can also be improved.

Further, in the case of exchanging the elastic member, the elastic member can be exchanged by merely detaching the cylinder head. Thus, since the elastic member can be exchanged without performing such a troublesome procedure as the detachment of the driving cylinder from the body like the related art, the maintenance property is good.

According to the second aspect of the invention, since the elastic members, each of which one end and the other end being engaged and locked with the movable sleeve and the cylinder head portion respectively, are disposed so as to have the same interval therebetween around the axis of the driving cylinder, the balance of the elastic members is good and so the movable sleeve can be operated smoothly and surely.

Other aspects and advantages of the invention will be apparent from the following description, the drawings and the claims.

BRIEF DESCRIPTION OF THE DRAWINGS

FIG. 4(*b*) is an explanatory diagram showing the arrangement state of three coil springs on the movable sleeve.

FIG. 4(*c*) is an explanatory diagram showing the arrangement state of a coil spring of a large diameter on the movable sleeve.

BRIEF DESCRIPTION OF REFERENCE NUMERALS AND SIGNS

Figure 1:
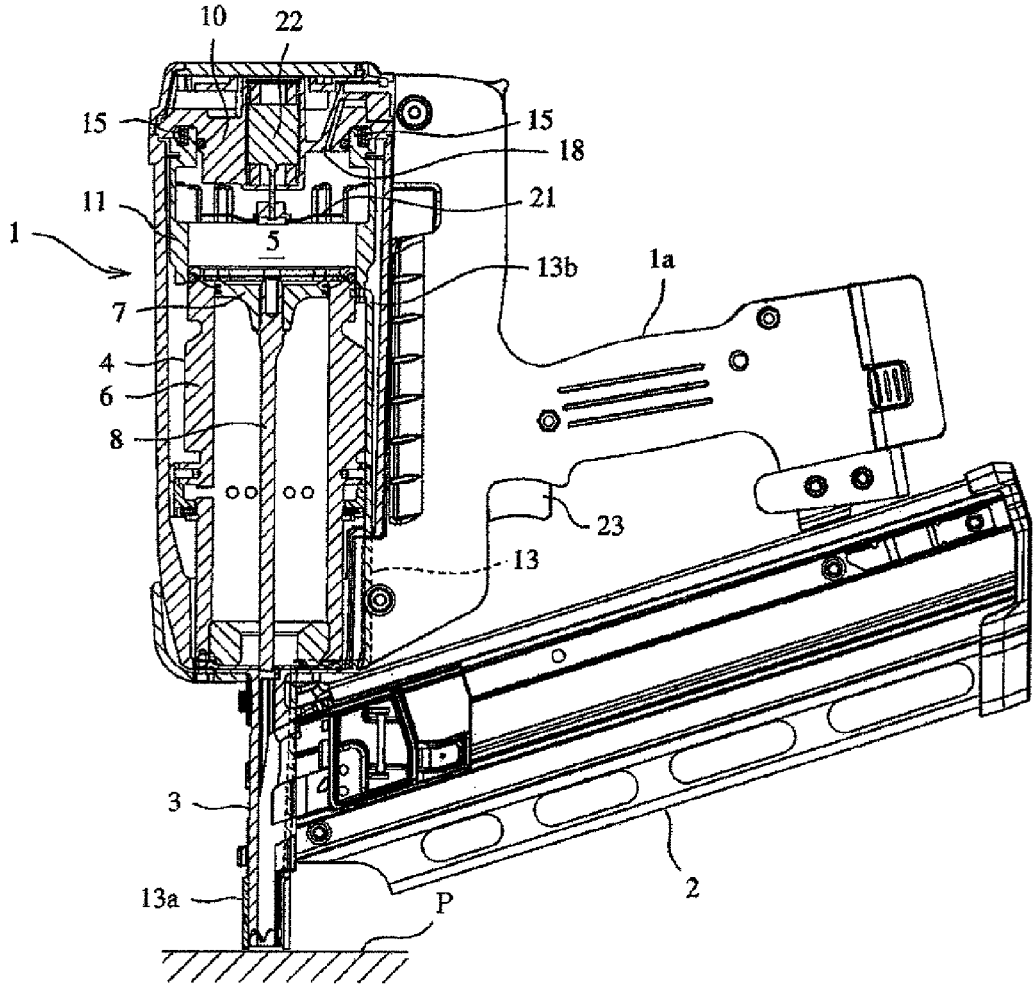
FIG. 1 is a longitudinal sectional diagram showing a state just before a gas combustion-type driving tool performs a driving operation.

1 body
6 driving cylinder
7 driving piston
8 driver
10 cylinder head
11 movable sleeve

BEST MODE FOR CARRYING OUT THE INVENTION

An embodiment of the invention will be explained with reference to FIGS. 1 to 3 in which the gas combustion-type driving tool according to the invention is applied to a nailer. FIG. 1 is an entire diagram showing a driving state of the gas combustion-type driving tool, FIG. 2 is an enlarged diagram showing the main portion of the tool and FIG. 3 is an enlarged diagram showing the main portion thereof in a non-operation state.

Figure 2:
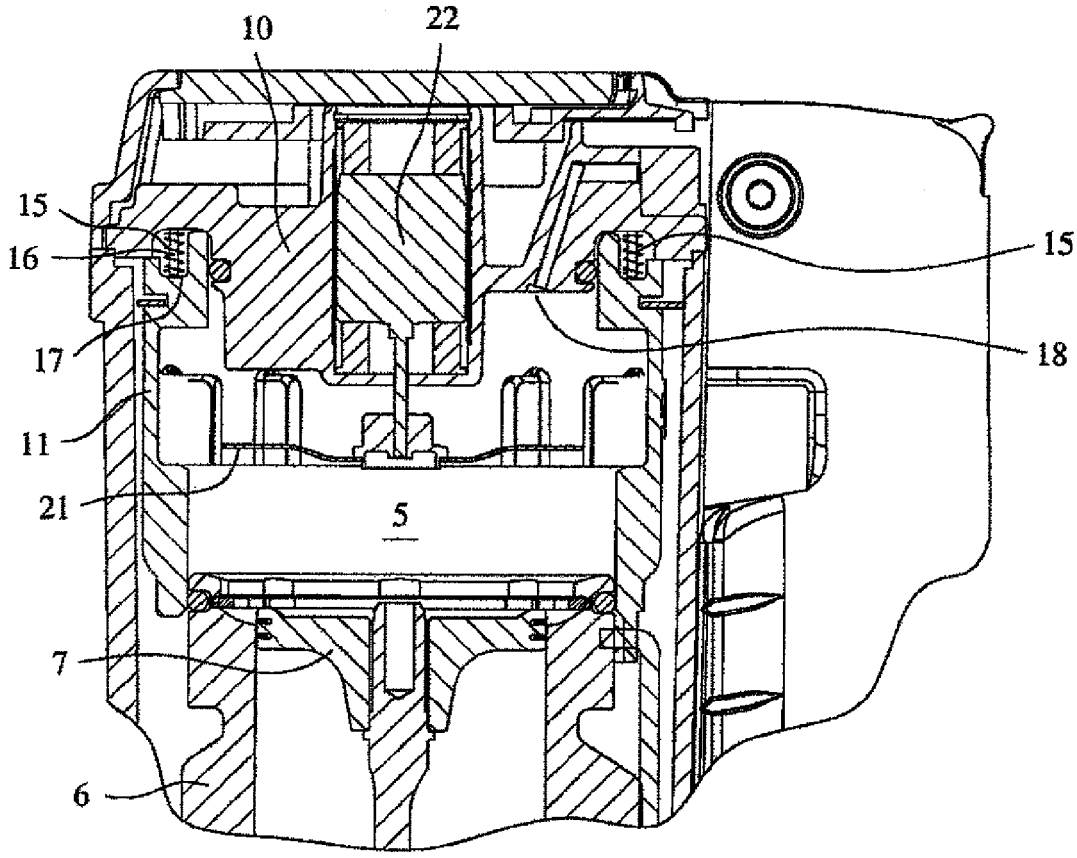
FIG. 2 is an enlarged diagram showing the main portion of FIG. 1.
Figure 3:
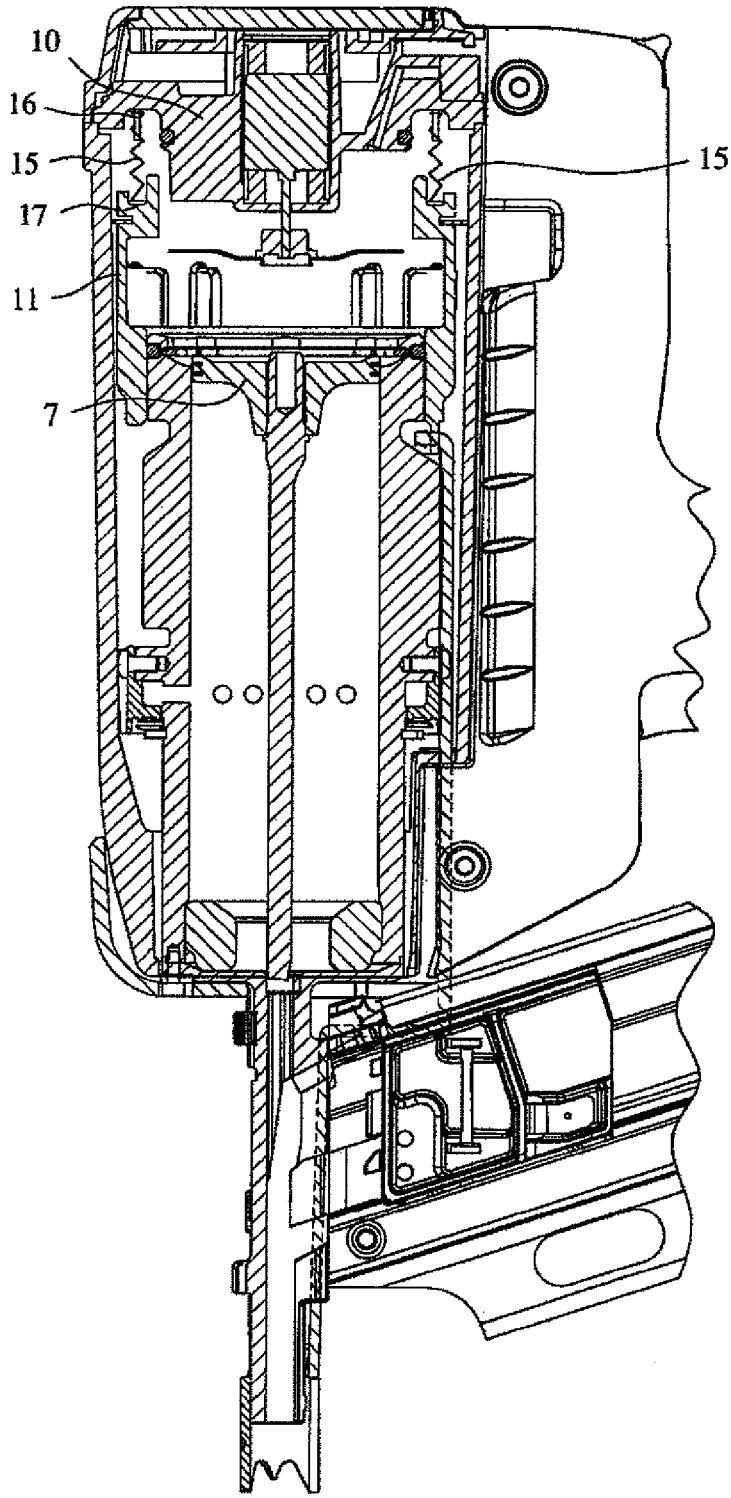
FIG. 3 is a longitudinal sectional diagram showing a state just after the gas combustion-type driving tool performs the driving operation.

In FIGS. 1 and 2, a reference numeral 1 depicts the body of the gas combustion-type driving tool. A grip 1*a* and a magazine 2 are coupled to the body 1 and a driving piston/cylinder mechanism 4 is provided within the body. A nose portion 3 for driving out a nail is provided at the lower portion of the body 1.

The driving piston/cylinder mechanism 4 houses a driving piston 7 within a driving cylinder 6 so as to be freely slidable and a driver 8 is integrally coupled at the lower portion of the driving piston 7.

Next, a combustion chamber 5 is configured at an upper portion of the driving cylinder 6 so as to be able to be opened and sealed. That is, the combustion chamber 5 is formed by an annular movable sleeve 11 which is disposed between the upper end surface of the driving piston 7 and a cylinder head 10 formed within the driving cylinder 6 and the upper portion of the body 1. The combustion chamber is configured in a manner that when the movable sleeve 11 is moved upward so as to seal on the cylinder head 10 side as shown in FIG. 1, the sealed combustion chamber 5 is formed, whilst when the movable sleeve is moved downward as shown in FIG. 3, the upper portion of the combustion chamber 5 is opened and communicates with the atmosphere.

The lower end of the movable sleeve 11 is coupled to the upper end 13*b* of a contact arm 13. The contact arm 13 is provided so as to be slidable freely along the nose portion 3 provided beneath the piston 6. The lower end 13*a* of the contact arm protrudes from the nose portion 3, and moves upward relatively with respect to the nose portion 3 when the portion 13*a* is pushed against a driven member P together with the nose portion 3.

Figure 4A:
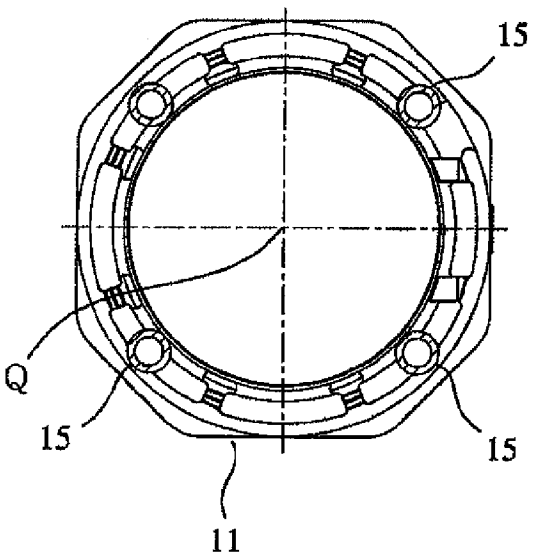
FIG. 4(*a*) is an explanatory diagram showing the arrangement state of four coil springs on a movable sleeve.
Figure 4B:
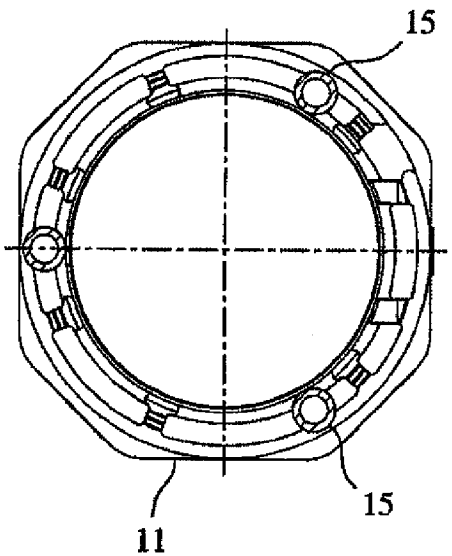
Figure 4C:
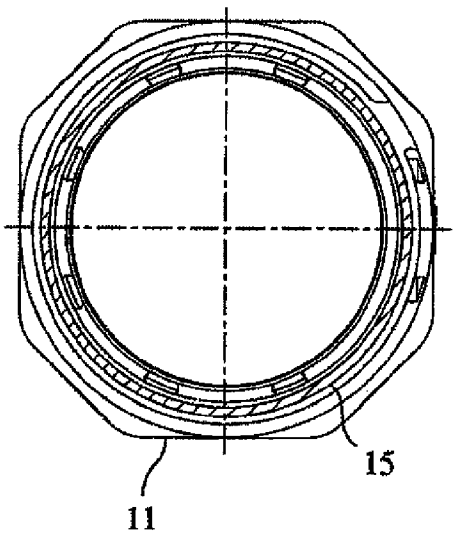

As shown in detain in FIGS. 2 and 4(*a*), coil springs (elastic members) 15 are disposed between the cylinder head 10 and the movable sleeve 11. The guide shaft 16 of the coil spring 15 is formed at the symmetrical position with respect to the axis of the driving cylinder 6 on the lower surface of the cylinder head 10. The receiving grooves 17 of the coil springs 15 are formed on the upper surface of the movable sleeve 11 in corresponding to the guide shaft. The movable sleeve 11 is normally biased downward by the coil springs 15 as shown in FIG. 3.

The cylinder head 10 is provided with an injection nozzle 18 communicating with a gas vessel and an ignition plug (not shown) for igniting and burning mixed gas. The upper body 1 is provided with a rotary fan 21 for mixing combustible gas injected within the combustion chamber 5 with the air within the combustion chamber 5 and stirring the mixed gas to thereby generate mixed gas of a predetermined air fuel ratio within the combustion chamber 5.

Next, the operation mode of the combustion chamber 5 will be explained. First, at the time of driving a nail, as shown in FIGS. 1 and 2, when the lower end 13*a* of the contact arm 13 is strongly pushed against the driven member P, the contact arm 13 relatively moves upward, whereby the movable sleeve 11 is pushed up and moved upward to abut against the cylinder head 10 provided above the driving cylinder 6 to thereby form the sealed combustion chamber 5. When the combustible gas is injected from the injection nozzle 18 within the combustion chamber 5, the motor 22 operates to rotate the rotary fan 21 to thereby stir and mix the combustible gas with the air.

Next, when a trigger 23 is pulled, the ignition plug ignites the mixed gas and so the mixed gas is burnt and expands explosively. The pressure of the combustion gas acts on the upper surface of the driving piston 7 and drives the piston downward in an impact manner, whereby the driver 8 strikes a nail at the head position (not shown) within the magazine 2 supplied within the nose portion 3 and drives the nail into the driven member P.

When the driving operation is completed, since the temperature within the combustion chamber 5 reduces abruptly, the upper space of the driving piston 7 having been expanded to the driving cylinder 6 is placed in a negative pressure state. Thus, as shown in FIG. 3, since the upper space is urged to return to its original capacity due to the pressure difference between the atmospheric pressure of the area beneath the piston and the negative pressure, of the upper space, the driving piston 7 returns to a top dead center. Then, when the nailer is pulled up to separate the nose portion 3 from the driven member P, the movable sleeve 11 and the contact arm 13 relatively move downward to thereby open the combustion chamber 5, whereby the procedure for the next driving operation is prepared.

Then, after a nail at the next position within the nose portion 3 is supplied, at the time of driving the nail, as described above, the lower end 13*a* of the contact arm 13 is strongly pushed against the driven member P to relatively move the contact arm 13 upward, whereby the movable sleeve 11 is pushed up against the coil springs 15 to form the combustion chamber 5, and then the nail is driven. When the driving operation is completed, the driving piston 7 returns to the top dead center. Then, when the nailer is pulled up to separate the nose portion 3 from the driven member P, the movable sleeve 11 and the contact arm 13 relatively move downward due to the biasing force of the coil springs 15 to thereby open the combustion chamber 5.

As described above, since the space for disposing the coil springs 15 is formed between the upper surface of the movable sleeve 11 and the lower surface of the cylinder head 10, it is not necessary to provide the dedicated space for disposing elastic members such as the coil springs 15 unlike the related art. Thus, the entire height of the tool can be suppressed to be low as compared with the case where the elastic member is provided at a dedicated space beneath the driving cylinder 6 at the lower portion of the driving cylinder 6. Similarly, since the elastic member is not disposed at the front portion of the nose portion or around the driving cylinder 6, the outer diameter of the tool can also be suppressed so as not to be large, which contributes to the miniaturization and the light-weight. Further, since the driving operation can be performed in a state that the tip end of the nose portion is inserted into a narrow space, the operability and the handling property can also be improved.

Further, in the case of exchanging the elastic member, the elastic member can be exchanged by merely detaching the cylinder head 10. Thus, since the elastic member can be exchanged without performing such a troublesome procedure as the detachment of the driving cylinder 6 from the body like the related art, the maintenance property is good.

Further, since the coil springs 15 are disposed so as to have the same interval therebetween around the axis of the driving cylinder 6 (also serving as the axis of the movable sleeve 11) and to have the same distance from the axis, the resultant forces of the downward biasing forces of the respective elastic members do not become unbalance in the transversal direction and in the longitudinal directions but coincide with the aforesaid direction, so that the movable sleeve 11 can be operated smoothly and surely.

Further, since the upward movement of the contact arm 13 and the movable sleeve 11 interlocked therewith at the time of pushing the contact arm 13 against the driven member P and the downward movement thereof after the completion of the driving operation are always performed by receiving the repulsive force of the coil springs 15, the direction of the strokes of these movements is influenced by the disposed positions of the coil springs 15. Unlike the disposed position of the related art, since the coil springs 15 are located on an extended line of the stroke of the coupled member of the movable sleeve 11 and the contact arm 13, the linearity of the stroke of the movements can be likely secured. That is, when the coil springs 15 locate inside of the movable range of the coupled member like the related art, the stroke of the movements is likely influenced by the swing movement around the coil springs 15. In contrast, according to the aforesaid configuration of the embodiment, the stroke of the movements is unlikely influenced.

The embodiment is not limited to the aforesaid arrangement that the four coil springs 15 (elastic members) are disposed between the cylinder head 10 and the movable sleeve 11. For example, as shown in FIG. 4(*b*), three coil springs 15 may be disposed. In this case, also the coil springs 15 are disposed so as to have the same interval therebetween around the axis of the driving cylinder 6 and to have the same distance from the axis. In this manner, in the case of providing a plurality of the coil springs 15, preferably the coil springs are disposed so as to have the same interval therebetween around the axis Q of the driving cylinder 6 and to have the same distance from the axis Q.

Alternatively, as shown in FIG. 4(*c*), a single coil spring 15 having a large diameter may be disposed on the circumference of the upper surface of the movable sleeve 11. That is, the coil spring 15 having the large diameter has a diameter larger than the inner bore of the movable sleeve 11 which penetrates the movable sleeve 11 in an up-down direction. In this case, preferably the guide shafts etc. are disposed with the same interval on the circumference so that loads act thereon uniformly.

Further, in this embodiment, although the contact arm 13 is configured by a single member, the contact arm may be configured by two or three members.

Although the invention is explained in detail with reference to a specific embodiment, it will be apparent for those skilled in the art that various changes and modifications may be made without departing from the gist and scope of the invention.

The present application is based on Japanese Patent Application (Japanese Patent Application No. 2006-229743) filed on Aug. 25, 2006, the content of which is incorporated herein by reference.

INDUSTRIAL APPLICABILITY

The invention can be used for the gas combustion-type driving tool for driving a faster such as a nail.

The invention claimed is:

1. A gas combustion-type driving tool, comprising:

a driving cylinder;

a driving piston provided within the driving cylinder so as to be movable in an up down direction;

a movable sleeve which is fitted on an outer peripheral side of the driving cylinder on the driving cylinder so as to be movable in the up-down direction;

a cylinder head which is provided above the driving cylinder;

a combustion chamber which is formed when the movable sleeve is moved upward and abuts on the cylinder head; and a biasing member which is positioned between the movable sleeve and the cylinder head and biases the movable sleeve downward, wherein no biasing member is provided between the outer peripheral side of the driving cylinder and an outer body of the driving tool, and wherein the driving cylinder is fixed and unmovable with respect to the outer body.

2. The gas combustion-type driving tool according to claim 1, wherein high-pressure combustion gas acts on the driving piston to thereby impulsively drive the piston when mixed gas of combustible gas and air is explosively combusted within the combustion chamber, and a fastener is driven out by a driver connected to a lower surface side of the driving piston.

3. The gas combustion-type driving tool according to claim 1, wherein the biasing member comprises a plurality of biasing members which are disposed so as to have a same interval therebetween around an axis of the driving cylinder.

4. The gas combustion-type driving tool according to claim 1, wherein the elastic member comprises a coil spring which penetrates the movable sleeve in the up-down direction and has a diameter larger than a diameter of an inner bore of the movable sleeve.

5. A gas combustion-type driving tool, comprising:

a driving cylinder;

a driving piston provided within the driving cylinder so as to be movable in an up-down direction;

a movable sleeve which is fitted on an outer peripheral side of the driving cylinder on the driving cylinder so as to be movable in the up-down direction;

a contact arm, wherein the movable sleeve is coupled to the contact arm through a coupling member, and wherein the contact arm is adapted to push up the movable sleeve when the contact arm is pushed against a driven member;

a cylinder head which is provided above the driving cylinder;

a combustion chamber which is formed when the movable sleeve is moved upward and abuts on the cylinder head; and an elastic member which is positioned between the movable sleeve and the cylinder head and biases the movable sleeve downward, wherein the driving cylinder is fixed and unmovable with respect to a body, and wherein the elastic member is collinear with a line extending through the elastic member and the coupling member of the movable sleeve and the contact arm.

* * * * *